US009596924B1

(12) United States Patent
Fully

(10) Patent No.: US 9,596,924 B1
(45) Date of Patent: Mar. 21, 2017

(54) WEARABLE LANYARD INCORPORATING A MECHANISM FOR SECURING AND DISPLAYING ONE OR MORE OBJECTS

(71) Applicant: Ivette Fully, Davie, FL (US)

(72) Inventor: Ivette Fully, Davie, FL (US)

( * ) Notice: Subject to any disclaimer, the term of this patent is extended or adjusted under 35 U.S.C. 154(b) by 0 days.

(21) Appl. No.: 14/656,059

(22) Filed: Mar. 12, 2015

(51) Int. Cl.
*A45F 5/00* (2006.01)
*A63H 33/08* (2006.01)

(52) U.S. Cl.
CPC ..... *A45F 5/00* (2013.01); *A63H 33/086* (2013.01); *A45F 2005/006* (2013.01); *Y10T 24/1374* (2015.01); *Y10T 24/1397* (2015.01)

(58) Field of Classification Search
CPC .. A63H 33/08; A63H 33/086; Y10T 24/1374; Y10T 24/1397; A45F 2003/002
USPC ..... 63/40
See application file for complete search history.

(56) References Cited

U.S. PATENT DOCUMENTS 4,936,699 A * 6/1990 Yoshida ..... A44C 5/00 401/48
6,047,709 A * 4/2000 Tu ..... A45D 8/00 132/273
6,289,903 B1 * 9/2001 Haufler ..... A01K 27/006 119/857
8,540,544 B1 * 9/2013 Logue ..... A44C 5/00 446/101

* cited by examiner

*Primary Examiner* — Robert J Sandy
(74) *Attorney, Agent, or Firm* — Daniel S. Polley, P.A.

(57) ABSTRACT

A wearable lanyard for securing and displaying an object, such as one or more mini-figs. A bottom fastener such as a ring can be provided at the bottom. A majority of the length on at least one side of the lanyard can be used as an object attachment area and provided with the connector mechanism. In one embodiment, the connector mechanisms can be raised studs. The lanyard can be worn as a decorative three-dimensional ornament around the wearer's neck and used to store and display mini-figs that are adhered or secured to the raised studs.

2 Claims, 3 Drawing Sheets

WEARABLE LANYARD INCORPORATING A MECHANISM FOR SECURING AND DISPLAYING ONE OR MORE OBJECTS

This application is a continuation of U.S. application Ser. No. 14/581,872, filed Dec. 23, 2014, now abandoned, which is a continuation of U.S. application Ser. No. 14/514,542, filed Oct. 15, 2014, now abandoned, which is a continuation of U.S. application Ser. No. 14/452,117, filed Aug. 5, 2014, now abandoned, which is a continuation of U.S. application Ser. No. 14/285,857, filed May 23, 2014, now abandoned, which is a continuation of U.S. application Ser. No. 14/200,806, filed Mar. 7, 2014, now abandoned, which is a continuation of U.S. application Ser. No. 14/091,975, filed Nov. 27, 2014, now abandoned, which is a continuation of U.S. application Ser. No. 14/020,200, filed Sep. 6, 2013, now abandoned, which is a continuation of U.S. application Ser. No. 13/912,828, filed Jun. 7, 2013, now abandoned, which claims the benefit of and priority to U.S. Provisional Patent Application Ser. No. 61/656,750, filed Jun. 7, 2012. All applications are incorporated by reference in their entireties.

FIELD OF THE INVENTION

The present invention relates generally a decorative element preferably worn around the neck of an adult or child.

BACKGROUND OF THE INVENTION

Lanyards have previously been created with specific uses to hold items such as eyeglass, electronics, badges or passes and for promotional purpose. Typically the lanyard is often a rope or cord that is wrapped around the neck with the object being carried secured at the lower end of the lanyard, when in use; such as by a hook or other fastener secured at the lower end. The rope or cord itself is not known to be used to secure an object.

SUMMARY OF THE INVENTION

The present invention generally provides a necklace, lanyard and/or other decorative neck element (collectively all referred to as "Lanyard") that can be worn by adults and/or children. In addition to preferably having a typical bottom fastener, the present invention Lanyard provides for one or more object attachment areas along the Lanyard itself. In one non-limiting embodiment, a majority of the length of the length on at least one side can be used as attachment areas and provided with the connector mechanism (i.e. raised studs, etc.). In another non-limiting embodiment virtually the entire length of at least one side can be used as attachment areas. The present invention Lanyard can be worn as a decorative three-dimensional ornament (preferably around the wearer's neck), and may also be used to store, display, collect and/or make accessible objects that could be adhered or secured to the raised studs that are provided along a majority of the length of at least one side of the Lanyard. The secured object(s) can include, but are not limited to, one or more mini-figs, such as those, manufactured by LEGO and similar companies.

DETAILED DESCRIPTION OF THE INVENTION

The present invention generally provides a necklace, lanyard and/or other decorative neck element (collectively all referred to as "Lanyard") that can be worn by adults and/or children, which, in addition to the typical bottom fastener, provides for one or more object attachment areas along the Lanyard itself. In one non-limiting embodiment, a majority of the length of the length on at least one side can be used as attachment areas and provided with the connector mechanism (i.e. raised studs, etc.) described below. In another non-limiting embodiment virtually the entire length of at least one side can be used as attachment areas.

The present invention Lanyard can be worn as a decorative three-dimensional ornament (preferably around the wearer's neck), and may also be used to store, display, collect and/or make accessible objects that could be adhered or secured to the raised studs that are provided along a majority of the length of at least one side of the Lanyard.

The studs can all be raised the same distance, or the distances can be the same for some of the studs, or the distances can be random.

In one non-limiting embodiment, the objects can be one or more mini-figs, such as those, manufactured by LEGO and similar companies. In one non-limiting embodiment, the studs protruding outward from the lanyard can be similar to the raised studs found on LEGO building blocks. However, any male mating portion, that correspondence to a female receiving portion on the object can be used and is considered within the scope of the invention. Alternatively, the male mating portion can be provided with the object and the female portion provide along the length of the Lanyard. A snap assembly and/or button/buttonhole assembly can also be used. All of the above Lanyard securement mechanisms for securing an object to the Lanyard at locations on the Lanyard other than, or in addition to, the common bottom securement location, are all considered within the scope of the invention.

Besides decorative items, identification badges, keys and other objects can be configured to be secure to the Lanyard at the alternative locations to the bottom of the Lanyard.

Figure 1:
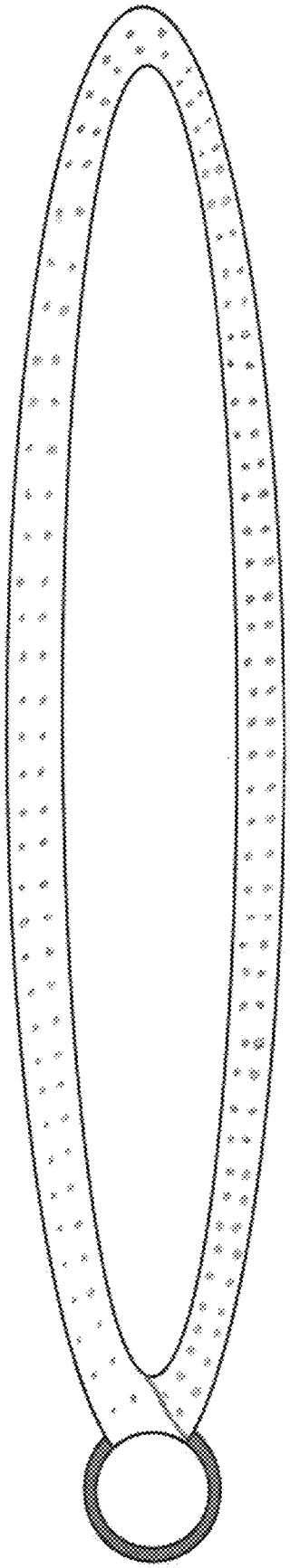
FIG. 1 is a perspective view of one non-limiting embodiment for the wearable lanyard in accordance with the present invention.
Figure 2:
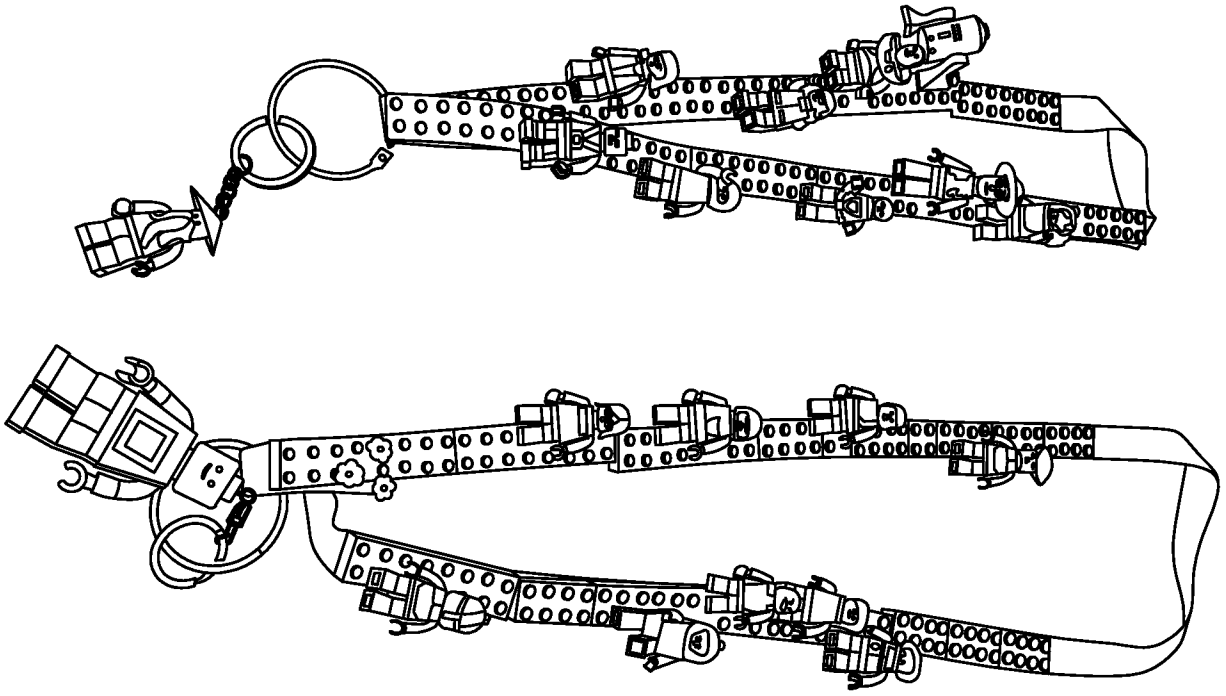
FIG. 2 is a perspective view of non-limiting embodiments of the present invention wearable lanyard showing the invention used to secure and display one or more objects that can be worn around the neck of the wearer, with a single color version on the left and multiple color version on the right.
Figure 3:
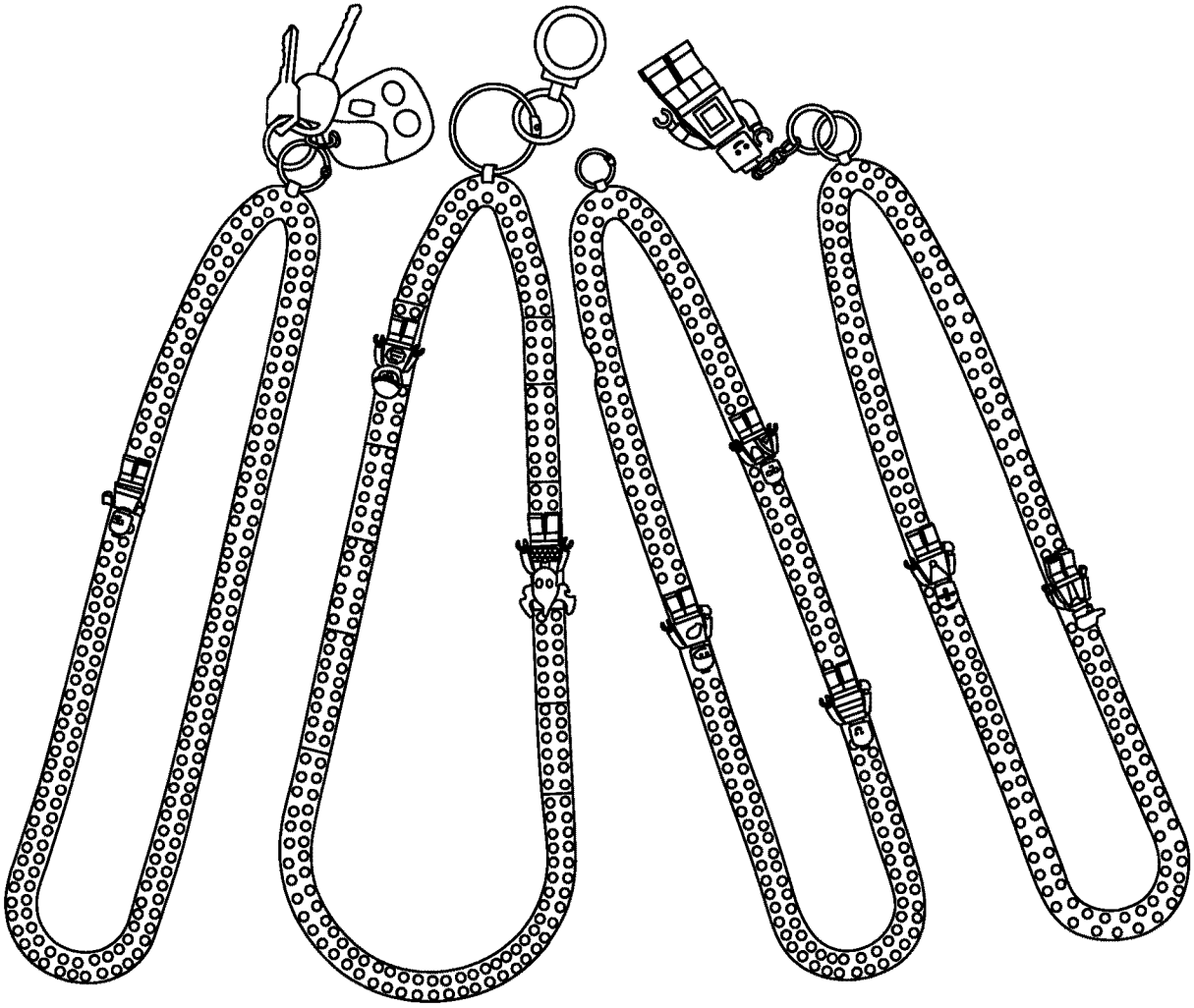
FIG. 3 illustrates several different non-limiting embodiments for the wearable lanyard in accordance with the present invention.

In one non-limiting embodiment, the lanyard can be constructed from a silicone lightweight material. Preferably, the lanyard has some flexibility and is not rigid, though such is not considered limiting. As seen in the early informal prototype versions shown in FIG. 2, each Lanyard can either be one solid color (left side) or one or more colors (right side). In either of these embodiments, the solid colors can be made in blocked in sections.

The external useful surface of the Lanyard material can be constructed to have two parallel or substantially parallel lines of protrusions. Alternatively a single line of protrusions or more than two lines of protrusions can be provided. In a preferred non-limiting embodiment, the protrusions can be studs. Also not considered limiting, the studs can be rounded in cross-sectional shape. However, any shape can be chosen as long as a corresponding mating shape is provided on the object for mating the object to one or more of the studs.

Where rounded, the round raised studs can also be a decorative element that adds texture to the Lanyard. In addition the Lanyard can also be used to hold a diverse collection of objects. In one embodiment, the object can be provided with a hollow base or backing or provided with an aperture that may be used for interlocking with one or more of the Lanyard studs that can be preferably provided along a majority of the length of the Lanyard. Any other object that can be provided with a circular hollow surface or mating aperture can also be similarly secured to the Lanyard. There is a round metal ring at the end of the jointed material.

A metal ring, hook, clip or other fastener (collectively "Bottom Fastener") can be secured to the bottom of the Lanyard by conventional means. The Bottom Fastener can be used for a variety of uses, including, but not limited to, hanging keys, key chain, securing an identification badge, attached a decorative ornament, attached a mini-fig, securing a whistle, etc.

Thus, the present invention provides a Lanyard that can be color blocked or one solid color, and in one use allows a person to secure one or more different mini-figs, random or by collection on the Lanyards such that the mini-fig(s) can be stored, displayed and/or easily accessible for other purposes, such as, but not limited to, trading with other mini-fig enthusiast.

The color combinations and patterns that can be used with the present invention are limitless and all combinations and patterns can be used and are considered within the scope of the invention.

The inventor is unaware of any other lanyards with round raised studs that allow an individual to interlock decorative items onto the lanyard.

All locations, sizes, shapes, measurements, amounts, angles, component or part locations, configurations, dimensions, values, materials, orientations, colors, etc. discussed above or shown in the drawings are merely by way of example and are not considered limiting and other locations, sizes, shapes, measurements, amounts, angles, component or part locations, configurations, dimensions, values, materials, orientations, colors, etc. can be chosen and used and all are considered within the scope of the invention.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A wearable lanyard for displaying an object, comprising:

a body member having a first side and in the form of lanyard in use;

a plurality of raised studs disposed on at least a portion of the first side of the body member adapted for removable securement of an object to the body member; and a ring member secured to the body member.

2. The wearable lanyard for displaying an object of claim 1 wherein said body member is a continuous body member.

* * * * *